United States Patent [19]

Kraemer et al.

[11] 4,098,648

[45] Jul. 4, 1978

[54] ROTARY SEPARATING AND EXTRACTING DEVICES

[76] Inventors: Philipp Kraemer, 34 Kendleton Dr., Rexdale; Otto Meresz, 8 Wallingford Rd., Don Mills, both of Ontario, Canada

[21] Appl. No.: 665,173

[22] Filed: Mar. 9, 1976

[30] Foreign Application Priority Data

Mar. 25, 1975 [GB] United Kingdom ..... 12518/75

[51] Int. Cl.[2] ..... B01D 11/02; C10G 1/04

[52] U.S. Cl. ..... 196/14.52; 23/269; 23/270 R; 208/11 LE

[58] Field of Search ..... 196/14.52; 208/11 LE; 23/269 R, 270 R

[56] References Cited

U.S. PATENT DOCUMENTS

| | | | |
|---|---|---|---|
| 581,451 | 4/1897 | Bell | 196/14.52 |
| 617,712 | 1/1899 | Bell | 196/14.52 |
| 655,430 | 8/1900 | Bell | 196/14.52 |
| 1,952,647 | 3/1934 | Alvey et al. | 196/14.52 |
| 2,337,137 | 12/1943 | Thompson et al. | 23/269 R |
| 2,433,552 | 12/1947 | Haney et al. | 23/269 R |
| 2,453,060 | 11/1948 | Bauer et al. | 196/14.52 X |
| 3,161,581 | 12/1964 | Tiedje et al. | 196/14.52 X |
| 3,189,536 | 6/1965 | Bodine | 208/11 LE X |

FOREIGN PATENT DOCUMENTS

| | | | |
|---|---|---|---|
| 637,941 | 3/1962 | Canada | 196/14.52 |
| 687,554 | 5/1964 | Canada | 208/11 LE |
| 1,161,945 | 8/1969 | United Kingdom | 23/270 R |

*Primary Examiner*—Barry S. Richman
*Attorney, Agent, or Firm*—Hirons & Rogers

[57] ABSTRACT

A rotary separator, specially adapted for extraction of bituminous materials from tar sands or shale, comprises an inclined vessel having a helical conveyor attached to it, provided with apertures at the radially outer portion of the helical flights. Material introduced at the bottom is conveyed upwardly, and solvent washes downwardly to dissolve out the bituminous material. The apertures in the helix permit downward passage of liquid but prevent substantial downward passage of solids. A solvent recovery vessel is provided for recovering residual solvent from the separated solids.

13 Claims, 8 Drawing Figures

ROTARY SEPARATING AND EXTRACTING DEVICES

FIELD OF THE INVENTION

This invention relates to apparatus and process for separating components of a solid mixture by washing with a solvent which selectively dissolves selected ones of the components. More particularily, it concerns an apparatus and process for separating components of a solid mixture by counter-current washing with a selective solvent, in which the solution so formed is lighter than the undissolved solids. In its specific aspect, the invention concerns apparatus and process for extracting tar or bitumen from naturally occurring deposits of inorganic materials and tar or bitumen for example tar sand and oil-bearing shale deposits.

Such deposits occur naturally in several places in the world, notably in Northern Alberta, Canada; Colorado, U.S.A.: parts of the Soviet Union and Brazil. They comprise bitumen in admixture with inorganic materials. The bitumen is an excessively viscous heavy oil, comprising high molecular weight hydrocarbons. There is great economic incentive at present to develop processes for recovery of the hydrocarbon values from tar sand and shale, to supplement existing oil supplies.

BRIEF DESCRIPTION OF THE PRIOR ART

Solvent extraction is one of the most promising methods for extracting the bitumen content therefrom. Since the bitumen is organic in nature, whereas the remaining constituents of the tar snad are inorganic, solvents which will selectively dissolve the bitumen, whilst leaving the sand and other inorganic constituents undissolved, are readily obtained. However, such organic solvents are relatively expensive, so that in an economic tar sand extraction process, they must be used with maximum efficiency, and means must be provided for recovering solvent for recycle purposes, so as to minimize solvent losses and consumption. Additional problems arise in solvent recoveries in that the separated inorganic component, sand or, in the case of shale, crushed rock, whilst not soluble in the organic solvent, tends to entrap organic solvents with which it comes into contact, by surface tension effects. The extracted inorganic material therefore, has to be treated to remove contaminated solvent, both to minimize solvent consumption and to ensure that the inorganic material is clean enough for return to the natural environment.

SUMMARY OF THE INVENTION

It is an object of the present invention to provide a new and improved apparatus and process for the solvent extraction of organic components from oil-bearing mineral deposits such as oil shales and tar sands.

It is a further object of the present invention to provide a novel apparatus for counter-current solvent washing of an oil-bearing mineral deposit in which clean inorganic residue is formed which can be returned to the environment.

It is a further object of the invention to provide a process and apparatus for solvent extraction of oil-bearing mineral deposits in which solvent consumption and losses are minimized.

In summary, the apparatus of the invention includes a rotating inclined washer vessel containing an open centered, apertured helix conveyor, the apertures in which comprise slots in the radially outer portion of the conveyor. Bituminous material such as tar sand or crushed oil shale is introduced at the lower end of the washer vessel and is conveyed upwardly by the helical conveyor as the washer vessel rotates. Solvent is introduced nearer the upper end of the vessel and flows downwardly through the conveyor slots, for counter-current washing.

The special arrangement of slots in the helical conveyor flights provide for efficient separation of the solid and liquid components, as the continuous tumbling agitation agitation of the solid-solvent mixture takes place in the washer vessel. The solution of bitumen in solvent is removed from the lower end of the vessel, while the separated inorganic solid material is removed from the upper end of the vessel. The solid inorganic material is then submitted to solvent recovery procedures in other parts of the apparatus.

The efficient separation and dissolving of the organic content of the bituminous-inorganic material is due in large part to the form of helical conveyor which is used and which rotates with the rotating washer vessel. As noted, the helix has radially outer apertures which allow the liquid component to flow downwardly through the rotating water vessel. The inner portion of the helix is substantially fluid impervious. Since the solution of organic material in solvent is lighter than the separated solid organic material, the natural tendency of the solution is to float. However, the radially outer apertures for liquid passage are at the bottom of the rotating vessel and helix, and by forcing the solution to pass through the bottom of the helix, more thorough washing and extraction is achieved.

DESCRIPTION OF THE PREFERRED EMBODIMENTS

The passageways of the apertures in the helix permitting liquid flow through the flights thereof are designed to permit liquid flow and substantially prevent solid movement through the apertures, as the helix and the vessel rotate. Thus, the apertures present a crooked passageway, with respect to the axis of the direction of upward travel of the solid material. Direct passage of liquid by axial flow through the apertures in the helix, is not permitted. Further, the entrance to each aperture in the upper surface of each flight of the helix is presented so that it is partially covered by a structural formation overlying the passageway and extending generally in the plane of the helix and in a direction opposite to the direction of rotation of the helix. By this means, a flow of liquid but substantially no movement of solid through the apertures in the downward direction is achieved, except for movement of very fine materials suspended in the liquid solution.

This is achieved since the formation partly overlying the entrance to the aperature trails against the solid material as the vessel and helix rotate, the solid material being generally disposed part way up the rotating wall of the vessel. The movement of the solid material is such as to brush across the opening to the aperature, in contact with the formation, and not to enter the aperture. However, the liquid solution, because of its liquid, extra mobile characteristics as compared with the solid material, collects generally at the bottom of the rotating vessel, and can flow freely through the crooked passageways presented by the apertures of the helix.

In a preferred form of the apparatus according to the invention, the washer vessel is associated with a residual solvent recovery vessel having a heating zone and a cooling zone. The solvent recovery vessel receives solid material from the washer vessel, and has therein agitating and conveying means adapted to convey solid material therein successively through the heating zone and the cooling zone. There is also provided means for recovering residual solvent evaporated from the solid material during conveyance through the solvent recovery vessel, and means for recovering cooled solid material from the solvent recovery vessel.

Since the present invention has been primarily developed for use in extracting the bitumen from tar sand and oil shales, it will be described in detail with reference to such processes. The term "tar sand" used herein should be understood to embrace oil shales since they are essentially similar once the oil shale has been crushed.

In a specific form of the invention, the formations overlying the entrance to the apertures in the helix and extending generally in the direction of rotation of the helix comprise resilient items such as spring steel strips. Such resilient items are adapted to be resiliently pressed by the solid material being conveyed by the helix, to close off the openings to the apertures in the helix, but to spring open again when the helix is not in contact with the solid material, and to remain open when the helix portion is in contact solely with the liquid solution in the vessel. Such spring items act as "valves", permitting liquid flow through the apertures in the helix, but being closed by the solid material to prevent movement of solids therethrough.

In the preferred form of the apparatus, there is also included a vibrating vessel, interposed between the washer vessel and the solvent recovery vessel. Even when complete dissolution of the organic content of the tar sand in the solvent has been accomplished, it is found that substantial quantities of solvent remain mixed with the separated sand, probably by surface tension effects. Subjecting the solvent contaminated sand to vibratory motion has been found to free some of this solvent from the sand.

The lowermost zone of the washer vessel is also preferably provided with a rotating scoop device, in the form of a strainer, which strains out residual solids from the solution collected at the lower end of the washer vessel, prior to its removal.

The solvent recovery vessel in the preferred form of the invention is also a rotating vessel provided with a helical conveyor, to convey the sand with tumbling agitation through the successive warming and cooling zones. No apertures are necessary in the helix of the solvent recovery vessel.

In one form, the solvent recovery vessel includes a stationary condenser, in which solvent evaporated from the contaminated sand is condensed and collected, for re-circulation and re-use. The sand, free from solvent, proceeds to the cooling zone, where it is cooled to ambient temperature. Upon exit from the solvent recovery vessel, the sand is clean and cool and ready for return to the environment.

In another form, the solvent recovery vessel contains no condenser, but is connected to the washer vessel in fluid tight manner. Means are provided blocking the center of the helix in the cooling zone, so that this means, in conjunction with the sand, seals the solvent recovery vessel against solvent vapour escape via the cooling zone. Solvent vapour thus returns from the solvent recovery vessel to condense in the washer vessel for re-use.

According to another aspect of the present invention there is provided a process of recovering organic bituminous components from inorganic-bitumen deposits by counter-current washing with a solvent for the organic component, which comprises:

pre-treating the inorganic-bitumen deposit material with a small amount of solvent which is insufficient to dissolve out large quantities or organic component;

feeding the pre-treated material to a lower zone of tumbling agitation;

conveying the pre-treated material with tumbling agitation in an upwardly inclined path to an upper zone of tumbling agitation;

introducing solvent into said upper zone of tumbling agitation and conveying said solvent in counter-current fashion against the direction of conveyance of the material through the lower zone of tumbling agitation;

passing solvent and solution downwardly through the bottom part of the upwardly inclined path past the upwardly moving solid material;

removing solution of organic material in the solvent from a position below the lower zone of tumbling agitation;

withdrawing solid material comprising inorganics contaminated sith solvent from the upper zone of tumbling agitation and feeding said contaminated inorganics to a solvent recovery zone.

The process of the invention also preferably includes the steps of heating the solvent contaminated material in a heating zone of the solvent recovery zone, to cause evaporation of the solvent therefrom, and then cooling the residual material.

During experiments conducted to find the most suitable solvents for the extraction of tar sand, it has been found that the lowest boiling petroleum hydrocarbons such as naphtha and kerosene are especially effective. These solvents effect penetration and extraction very rapidly, and the sand suspension thus formed shows good settling characteristics. Use of petroleum hydrocarbons is advantageous, because, by their nature, any solvents remaining in the extracted bituminous components will not interfere with further refining-cracking processes, but rather act as a source of hydrogen in the thermal and catalytic treatment. Also, these hydrocarbons are among the products of the refining process, and thus are available on site or within the extraction-refining cycle. Chlorinated solvents can also be used, such as dichloroethylene, but these have to be removed from the bituminous content, to prevent their interference with the refining and cracking operations.

Control of the amounts of solvent, in relation to the amount of soluble organic material in the bituminous deposit, is desirable on grounds of economy and working efficiency. It has been found desirable to add from about ½ part by weight to about 1½ parts by weight, preferably about 1 part by weight, of solvent per part by weight of soluble organic component of the deposit. The overall total amount of solvent used, i.e. both in the pre-treatment and fed to the washer vessel should be at least 2½ parts by weight, and preferably from about 3 to about 5 parts by weight, per part by weight of soluble organic components. Higher amounts are not harmful, but are wasteful and unnecessary.

BRIEF REFERENCE TO THE DRAWINGS

Figure 1:
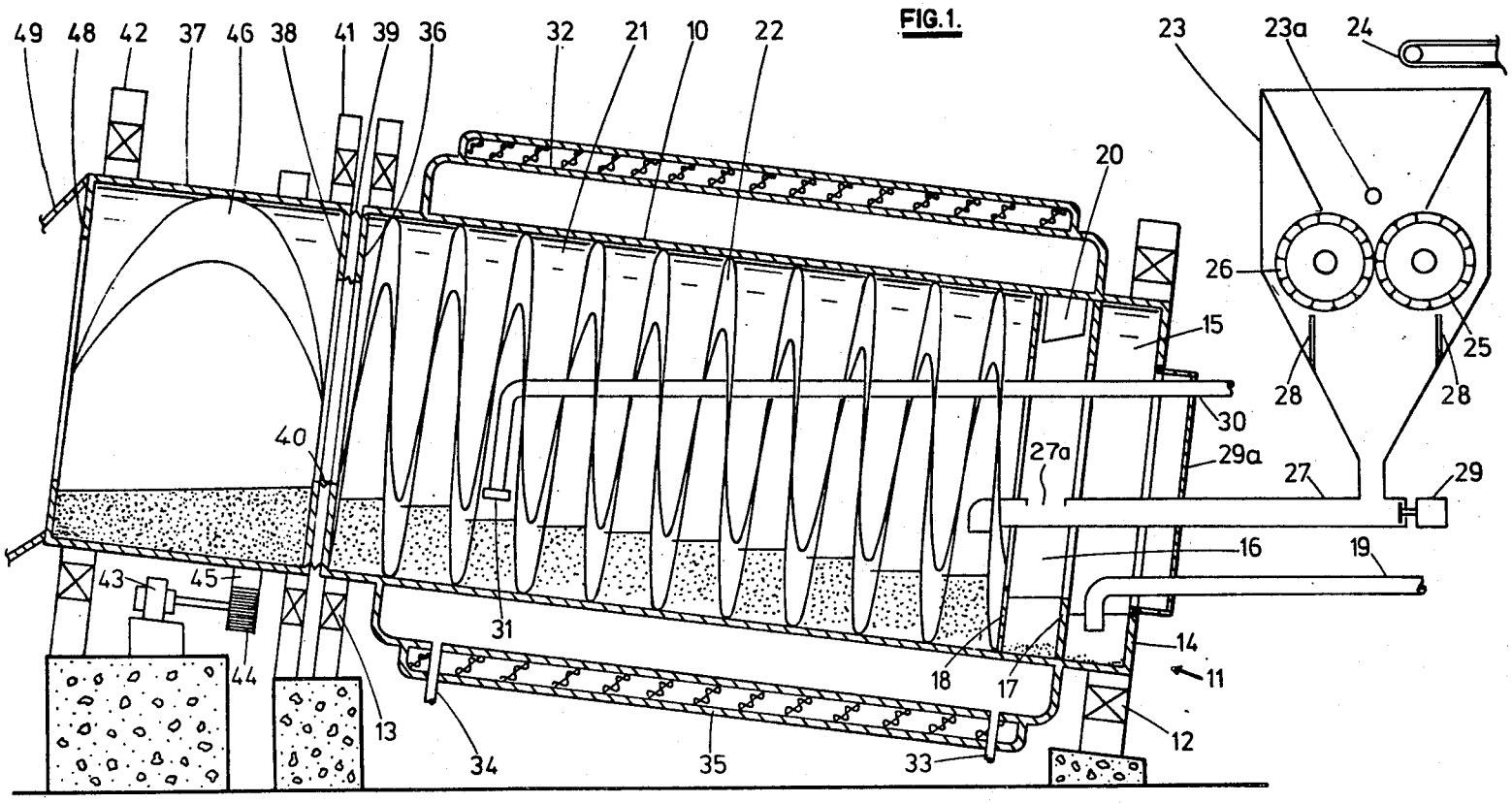
FIG. 1 is a longitudinal cross-sectional view of a washer vessel and associated parts in accordance with one embodiment of the invention.
Figure 2:
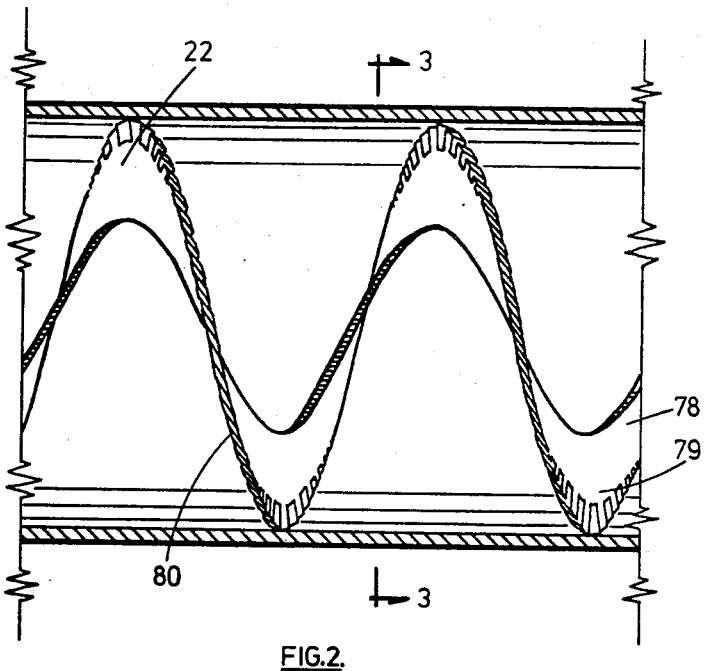
FIG. 2 is a detailed cross-section of a portion of the washer vessel of FIG. 1, showing the helix in place.
Figure 2A:
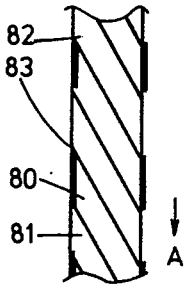
Figure 2B:
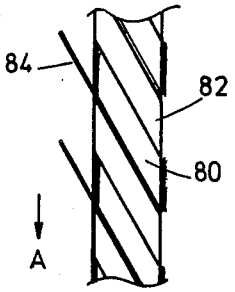
Figure 3:
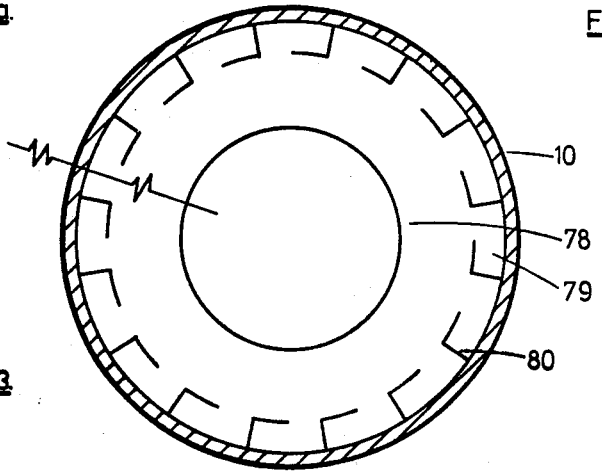
Figure 4:
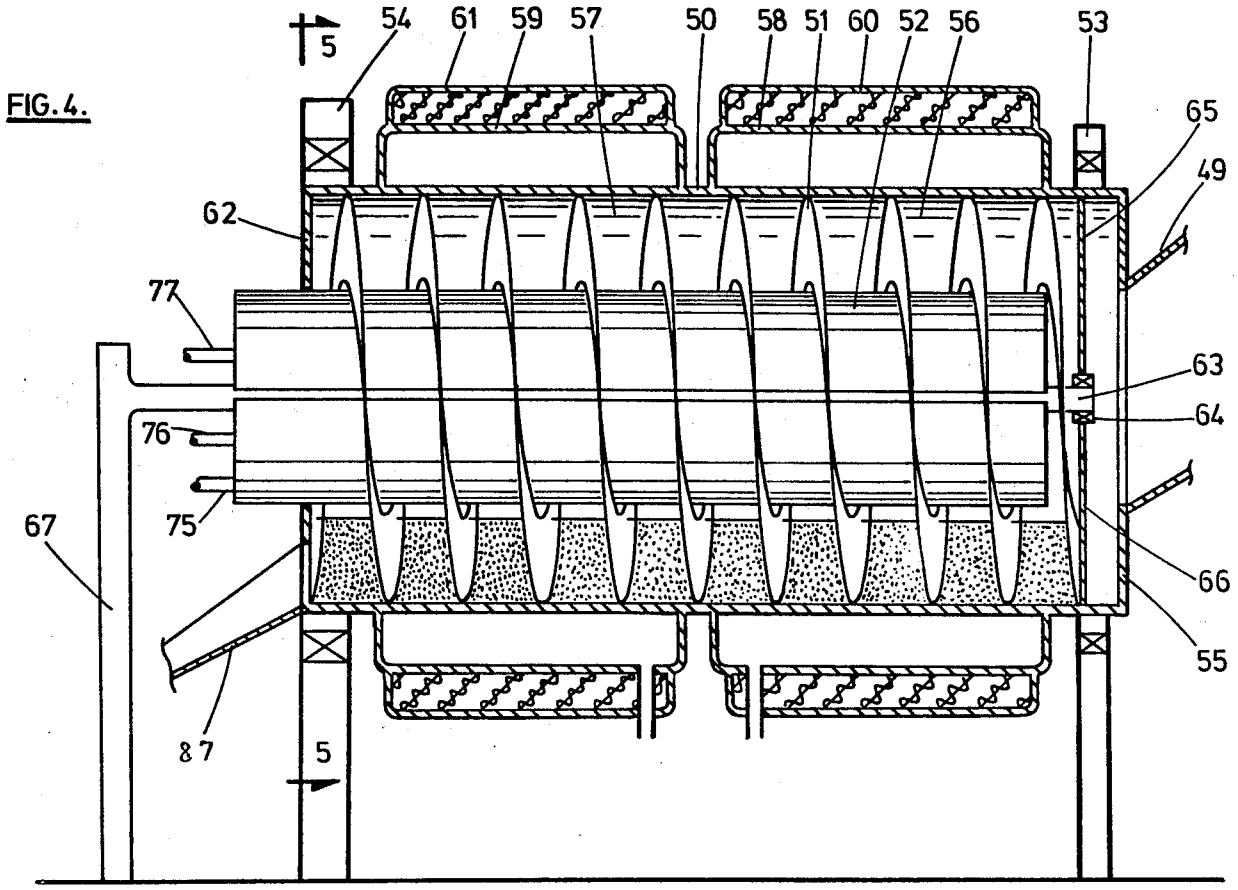
Figure 5:
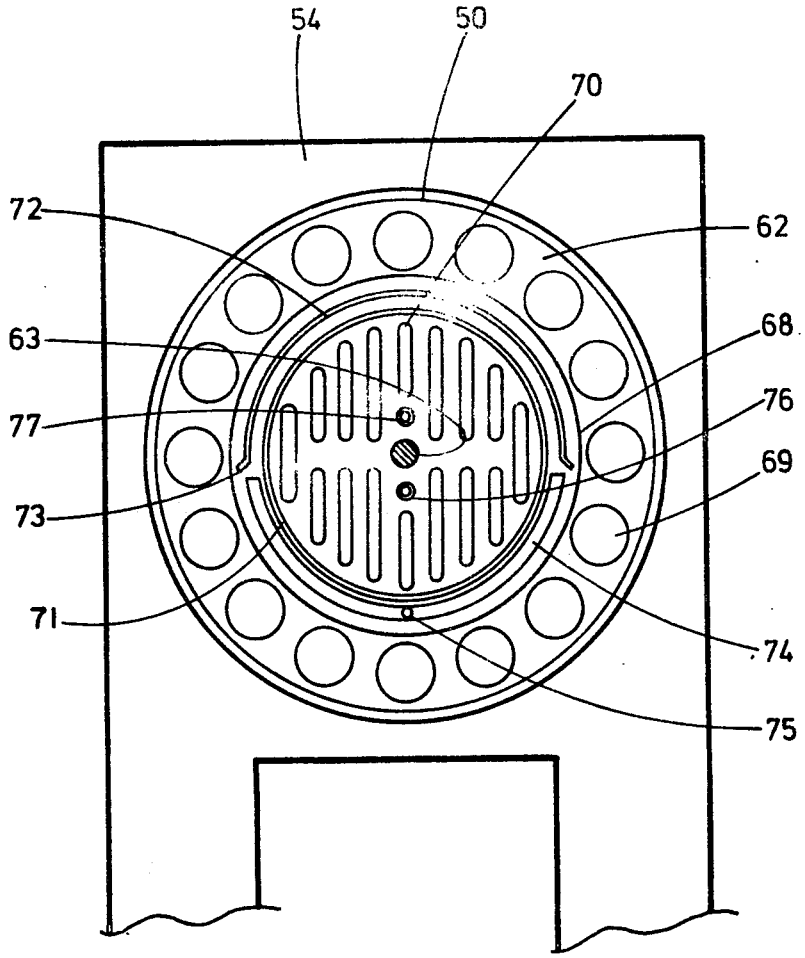
Figure 6:
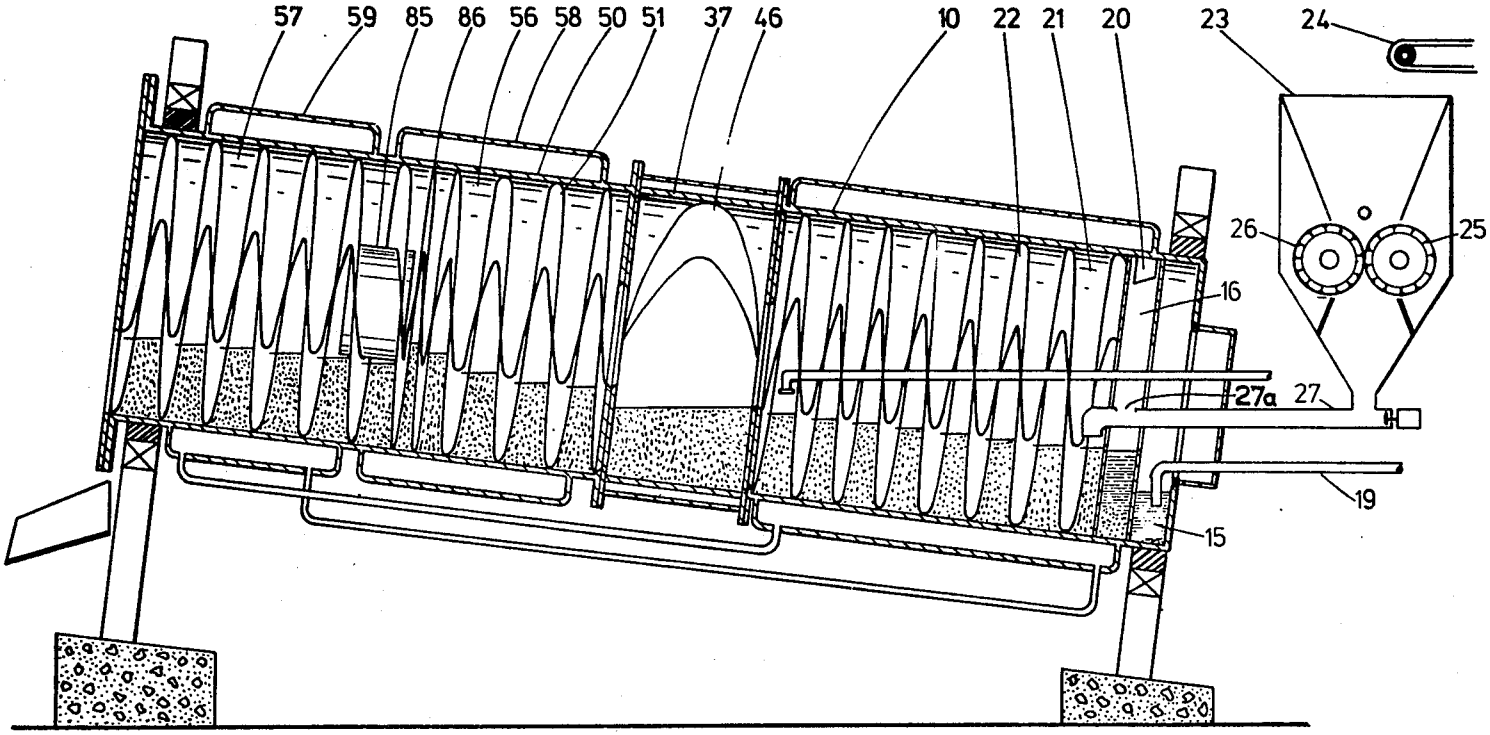

FIG. 2*a* is an edge view of a fragment of the radially outer edge of the helix according to one embodiment;

FIG. 2*b* is an edge view similar to FIG. 2*a* of another embodiment;

FIG. 3 is a cross-section on the line 3—3 of FIG. 2;

FIG. 4 is a longitudinal cross-sectional view of a residual solvent recovery vessel and associated parts for use in conjunction with the washer vessel of FIG. 1;

FIG. 5 is a view along the line 5—5 of FIG. 4;

FIG. 6 is a longitudinal cross-sectional view of a combined washer vessel and solvent recovery vessel according to a second embodiment of the invention.

In the drawings, like reference numerals indicate like parts.

DETAILED DESCRIPTION OF SPECIFIC PREFERRED EMBODIMENTS

With reference to FIG. 1, the apparatus according to the invention comprises a rotatable generally cylindrical washer vessel 10. As shown, it is mounted at an incline to the horizontal, in practice about 5°-18° and is rotatable about its longitudinal axis, using suitable driving means not shown.

At its lower end 11, the washer vessel is rotatably supported on ring bearing 12 and at its upper end on ring bearing 13. The lower end 11 of the vessel 10 is provided with an annular end plate 14. It has two lower compartments, the first, lowermost 15 of which is bounded at its lower extremity by annular end plate 14, and the second, upper of which 16 is bounded by a second annular plate 17 at its lower end, common with lowermost compartment 15, and at its upper end by third annular plate 18. The lowermost compartment 15 is provided with an exit pipe 19, through which liquid solution deposited in compartment 15 can be led off. Second compartment 16 is provided with a scoop device 20 secured to the inner surface of the cylindrical vessel wall.

Upwardly of the second compartment 16, and bounded by annular plate 18 at its lower end, the washer vessel 10 has a main chamber 21. The main chamber 21 has disposed therein, rigidly affixed to the internal cylindrical wall, an open centered helical ribbon 22 of substantially constant helical pitch. The pitches of the open helix 22 effectively divide the main chamber 21 into a plurality of successive upwardly disposed zones. The radially outer portions of the helix 22 are apertured, as described in more detail below.

A tar sands introduction means is provided at the lower end 11 of the washer vessel 10. This introduction means comprises a hopper 23, into which bituminous tar sand is fed by means of a conveyor 24 from storage. Whilst in hopper 23, the tar sand is wet with small amounts of solvent, by solvent inlet nozzle 23*a*. A pair of crushing rollers 25, 26 with radial crushing teeth are disposed at the bottom exit from the hopper 23, through which the wetted tar sand can leave the hopper 23 and drop into closed inlet conduit 27. Scrapers 28 are provided to scrape the bottom surfaces of rollers 25, 26 to prevent adherence ot the tar sand to the rollers as they rotate. A diaphragm pump 29 moves the material forwardly through the inlet conduit 27. The inlet conduit 27 extends forwardly through the central apertures in annular plates 14, 17 and 18, and terminates at its forward end at the lower end of main chamber 21 of vessel 10. Thus wetted tar sand is pretreated with solvent, reduced to suitable consistency by crushing rollers 25, 26 and then delivered via conduit 27 to the lower end of main chamber 21, into the pitch of the helix 22.

A bearing seal 29is provided which is stationary with respect to the cylinder 10, but closes the aperture in the end plate 14, to prevent solvent vapor escape. Conduit 27 and exit pipe 19 pass through sealed apertures in seal 29*a*.

A solvent inlet pipe 30 is provided, extending from a source of solvent supply not shown. Pipe 30 extends through a sealed aperture in bearing seal 29*a*, through the central apertures in annular plates 14, 17, 18 and through the open center of the helix 22, to a position about three quarters of the way towards the upper end of the main chamber 21. The solvent inlet pipe terminates in an outlet nozzle 31 which extends downwardly but at an angle to the vertical.

The main chamber 21 and the chamber 16 of the vessel 10 are surrounded by a heat exchange jacket 32 provided with a fluid inlet conduit 33 and a fluid outlet 34, for heating the main chamber by hot fluid supply. The heat exchange jacket 32 is lined on its exterior surface with an insulation layer 35. The upper end of the main chamber is defined by an upper annular end plate 36.

Flexibly connected to the upper end of main chamber 21 is a generally cylindrical vibrating chamber 37. The vibrating chamber 37 is of generally the same diameter as main chamber 21, and is mounted substantially coaxially therewith. At its lower end, vibrating chamber 37 is bounded by an annular end plate 38, generally the same as upper end plate 36 of main chamber 21. The vibrating chamber 37 is flexibly connected to main chamber 21 by means of flexible accordion type circular sleeve connectors 39, 40 of oil resistant rubber for example, so that the connection between chambers 37 and 21 is substantially fluid tight but permits vibration of chamber 37 relative to rotating chamber 21.

Vibrating chamber 37 is adapted to be rotated about its axis, along with main chamber 31, and is mounted in respective lower rearward ring bearing 41 and upper forward ring bearing 42. To impart vibration to the chamber 37 as it is rotated, there is provided a vibrating motor 43 driving a gear 44 which engages a ring gear 45 on the exterior of the chamber 37. The vibrating chamber 37 is provided, secured to its inner cylindrical surface, with a half turn of an open centered helix 46. The helix 46 is arranged in the same sense as the helix 22 of the main chamber 21, so as to continue conveyance of material in an upward direction on rotation together of chambers 21 and 37. The pitch of helix 46 is much larger than the pitch of helix 22 in the main chamber 21, so that material delivered to chamber 37 has a period when it is vibrated but not agitated.

The forward upper end of vibrating chamber 37 is provided with an annular end plate 48, to the forward end of which is journalled an exit chute 49 connecting to the residual solvent recovery vessel 50 illustrated in FIG. 4. The end plate 48 rotates with the cylinder 10, whilst chute 49 remains stationary.

With reference now to FIG. 4, the vessel 50 for recovering residual solvent comprises a rotatable cylinder having affixed to the inner cylindrical surface an open centered helix 51. A stationary, generally cylindrical condenser unit 52 extends longitudinally of the vessel 50. The vessel 50 is generally horizontal and is rotatably supported in a rear ring bearing 53 and a forward ring bearing 54.

At its rearward end, the vessel 50 has an annular end plate 55 to which the end of exit chute 49 is journalled, to allow passage of material from chamber 37 to vessel 50. The material, which is sand contaminated with residual solvent, is deposited in the rearward end of rotating vessel 50, into the pitch of the helix 51. It is conveyed forwardly as the vessel 50 and helix 51 rotate.

The vessel 50 is effectively divided into a first heating zone 56 and a second cooling zone 57. A heating jacket 58 surrounds the heating zone 56, and has suitable inlets for the circulation of heated fluid. A cooling jacket surrounds the cooling zone 57, and has suitable inlets for circulation of cold fluid. The heating jacket 58 and cooling jacket 59 are provided on their outer surfaces with respective insulation layers 60, 61. The material entering the rearward end of the vessel 50 is conveyed successively through heating zone 56 and cooling zone 57. The forward end of the vessel 50 has an annular end plate 62 which rotates with the vessel.

The condenser 52 has a central axle 63 by means of which it is supported at each end of the vessel 50. At the rearward end, the axle 63 has a bearing 64 by means of which it is supported on radial arms 65, 66 secured to the cylindrical surface of the vessel 50. At its forward end, it is rigidly supported on a post 67. Thus the condenser remains stationary as the cylinder 50 is rotated.

The form of the upper end plate 62 and condenser 52 are also illustrated in FIG. 5, which is a view along the line 5—5 of FIG. 4. The cylindrical vessel 50 is rotatably mounted in bearing 54. The end plate 62 of vessel 50 has a central aperture 68 through which the condenser 52 extends, and a series of circumferentially spaced apertures 69 arranged around its rim. The condenser 52 has a central axle 63 for support purposes, and a plurality of inter-connecting fluid circulating condenser pipes 70 surrounded by a metal cylinder 71. The condenser is also provided with an upper cover plate 72 with deflector formation 73 at its lower edges, and a lower collector tray 74. In operation, the solvent is condensed and collected in tray 74, from where it is led out through outlet pipe 75. Cover plate 72 prevents sand, moved up the walls of cylindrical vessel 50 as it rotates, from entering condenser collector tray 74. Inlet and outlet conduits 76, 77 for fluid circulation through the condenser pipes 70 are provided.

With reference to FIGS. 2, *2a*, *2b* and 3, it is seen that the helix 22 in the washer vessel 10 has an open centre, and a radially inner solid, fluid impervious portion 78 and a radially outer portion 79 with a series of circumferentially spaced slotted apertures 80 therethrough. These slots 80 are arranged obliquely to the longitudinal axis of the helix 22, and present a tortuous passage through the helix flights, for liquid flow. The openings thereof are presented generally away from the direction of travel of material conveyed upwardly by the helix 22.

Direct flow of material through the slots 80, parallel to the axis of the helix 22, is not permitted. The slots 80 are defined by parallelogram shaped formation 81, the faces 82 of which in the direction of forward conveyance of material by the helix 22 extend in the direction A of rotation of the helix 22. The formation 81 thus defines entrances for the slots 80 which present an oblique angle 83 to the material being conveyed by the rotating helix.

In the alternative embodiment shown in FIG. *2b*, the parallelogram formations 82 are provided with spring steel strips 84 further overlying the entrances to the slots 80, so that again the material being conveyed by the helix as it rotates in direction A is met by an oblique angle formation defining the entrance to the slotted aperture 80.

The operation of the apparatus illustrated in FIG. 1–5 will now be described.

Vessels 10 and 50, with their associated annular end plates and associated helices 22, 51 are set rotating at a suitable speed, which is fast enough to raise the solids part way up the side of vessel 10, but not to sling it around in vessel 10. Chamber 37 with its associated helix 46 is set rotating at the same speed as chamber 10 and 50, and is set vibrating, at a frequency of about 30–100 cycles per second. Tar sand material is conveyed by converyor 24 into hopper 23, where it is mixed with about 1 part by weight of solvent, per 1 part by weight of organic bituminous material in the tar sand, determined by previous analysis, supplied through nozzle 23*a*. This is sufficient solvent to produce a homogeneous material, capable of forming a weak sheet which will breakup into particulate form under its own weight.

The tar sand thus wetted with solvent is fed through rollers 25, 26 where mixing and homogenizing is effected, and is dropped into pipe 27, in which it falls in generally particulate form. Now it is pumped into the lower end of the main chamber 21 of rotating washer vessel 10. At the same time solvent is delivered to the upper part of chamber 21 via solvent pipe 30 and nozzle 31. Tar sand is conveyed upwardly by helix 22 so that the upward direction through washer vessel 10 is the downstream direction with respect to the direction of flow of solid material to meet a downwardly flowing stream of solvent. The solvent dissolves the tar or bitumen, and the solvent-bitumen solution moves downwardly through the various zones of the main chamber 21. Since the solution is lighter than the undissolved sand, the solution effects a thorough washing of the solids before it finds its way through the apertures 80 of the helix 22, which are located at the radial outer edge of the helix, i.e. at the bottom thereof. Passing through these downwardly located slots and downwardly to the bottom of the inclined cylinder 10 is against the natural tendency of the solution to float on the sand, so that it substantially increases the washing efficiency. Rotating cylinder 10 and helix 22 cause continuous tumbling and mixing of the tar sand and solvent, with counter-current washing to effect maximum extraction of bitumen by the solvent.

The rotation of cylinder 10 tends to cause solid material to rise part way up the walls of the cylinder and fall back, with a continuous tumbling action. However, the liquid solution remains disposed in the bottom of the rotating cylinder, due to its greater fluidity. The liquid is free to flow through the oblique slots 80 in the helix, since it is fluid enough to be able to follow the tortuous path. The solid material, however, will not pass through the slots 80, because of their tortuous arrangement, and because the slots are angularly disposed, with overlying formation 82 or 84 at their entrances to trail against the solid material as the helix rotates relative to the solid material. Thus the solids brush across the forward surfaces 82 and 84 and have no component of motion permitting them to enter the angled slots 80. This separation action is assisted by the thixotropic characteristics of the material. Since the solids will tend to be disposed part way up the wall of the rotating cylinder 10, the nozzle 31 delivering the solvent is directed at an angle to the vertical, to impinge initially upon the solid mass.

At the bottom of the main chamber 21, the bitumen-solvent solution overflows through the central aperture in plate 18 into compartment 16, the apertured plate 18 thus constituting a weir. Here it is subjected to the action of scoop 20 which rotates with the rotating cylinder 10, picks up residual sand settled in chamber 16 and drops in into pipe conveyor 27, which is apertured at 27*a* for this purpose, to mix with fresh incoming tar sand for delivery back to the main chamber 21.

The solution of bitumen extracted from the tar sand then overflows through the aperture in plate 17, into the lowermost compartment 15 of the rotating cylinder 10. From compartment 15, the solution is pumped off, through pipe 19 communicating with the upper portion of the solution, to refinery or storage. The solution so obtained contains only very small amounts of extremely fine insoluble inorganic matter, which can be settled out on storage.

The arrangement as described provides for extremely efficient washing and extraction of the organic content of the tar sand, by the counter-current action of the solvent and the tumbling agitation and conveying of the cylinder 10 and associated helical conveyor 22. The separation is facilitated by the arrangement of the apertures 80 at the bottom of the helix flights, and angularly to prevent solid passage, as described. Heating can be applied to main chamber 21 if desired by means of heating jacket 32, to adjust the rate of extraction of the tar sand.

As the solid material reaches the upper end of main chamber 21, it comprises sand substantially completely free from bituminous material. However, the sand has substantial amounts (about 25% of its own weight) of solvent adhering to it, largely through surface tension effects. For an economic and acceptable tar sands extraction process, it is necessary that this solvent be recovered and re-used, and that the sand be substantially free from residual solvent before it is returned to the environment.

This solvent bearing sand is conveyed by the helix 22 out through the aperture in upper end plate 36, into chamber 37 which is both rotating and vibrating. In this chamber it has a period when it rests under vibration and rotation of the chamber only, free from agitation by the helix 46. As illustrated, the pitch of helix 46 is at least twice that of helix 22 in the main chamber 21, and vibrating chamber 37 and main chamber 21 rotate at the same speed. Thus sand delivered from main chamber 21 has at least half a revolution during which it is not tumbled by the helix, but rests on the rotating cylinder wall under vibration. This causes substantial amounts of the residual solvent to rise above the sand and return to main chamber 21. The solvent content of the sand is thus reduced to about 12%.

The 12% solvent content of the sand leaving vibrating chamber 37 is still unacceptably high, both in terms of economic solvent losses and sand contamination. Hence the sand from vibrating chamber 37 is conveyed by helix 46 out through apertured end plate 48, down chute 49 and into the heated zone 56 of residual solvent recovery unit 50 (FIG. 4). Heat supplied to heating jacket 58, raising the temperature in heated zone 56 to about 200° F, either by hot fluids or induction heating, etc. The sand is agitated by the tumbling action of the helix 51 as vessel 50 rotates, and the solvent is evaporated from it. Solvent vapour enters between the cover plate 72 and the pan 74 of the condenser, collects in pan 74 and is pumped out of pipe 75. The configuration of cover plate 72 prevents sand, which may be carried up the wall of rotating cylinder 50, from falling into the solvent in pan 74.

The sand is substantially totally free from residual solvent by the time it reaches the cooling zone 56 of vessel 50. Cooling water is supplied to jacket 59, so that the sand is cooled to ambient temperature by the time it is conveyed by helix 51 out of the apertures 69 in end plate 62 and down exit chute 87. The heat extracted from the hot sand is then recovered in the water of the cooling jacket.

This process and apparatus can be operated continuously to give substantially complete extraction of bitumen from tar sand, minimal solvent consumption and clean cool sand ready for return to the environment.

FIG. 6 shows in diagrammatic longitudinal cross-section a different but similar apparatus according to the invention. In this embodiment, no condenser is included, arrangements being made to re-circulate solvent vapours from the residual solvent recovery vessel to the washer vessel.

The embodiment of FIG. 6 includes a conveyor 24 feeding tar sand material to a hopper 23 in which it is wet with solvent. The tar sand is fed out of hopper 23 through crusher rollers 25, 26 into inlet pipe 27 through which the tar sand is pumped to the lower end of main chamber 21 of rotating washer vessel 10. The washer vessel 10 is inclined as in the embodiment of FIGS. 1–5, and has similar lower compartments 15 from which solution is extracted via pipe 19, and 16 with sand scoop 20, and a similar slotted helical conveyor 22. A vibrating rotating chamber 37 is flexibly connected to the upper end of main chamber 21, to which sand contaminated with solvent is delivered from main chamber 21. The vibrating chamber 37 contains a half turn of helix 46 which is twice the pitch of the helix 22, and provides for vibrational rest. The vibrating chamber 37 is connected in fluid tight manner to main chamber 21 at its upper end, and to solvent recovery vessel 50 at its upper end.

The solvent recovery vessel 50, whilst generally of the same form as the corresponding vessel in the embodiment of FIG. 1–5, having a helical conveyor 51, heating zone 56 surrounded by a heating jacket 58, and a cooling zone 57 surrounded by a cooling jacket 59, has no condenser. Near the upper end of the heating zone 57, the central aperture in the helix 51 is sealingly closed for two pitches by a cylindrical formation 85 secured to and rotating with the helix. The formation 85, follows a portion 86 of the helix where the flights are only half the pitch of those lower down. This causes sand build-up as illustrated. The combination of formation 85, sand build-up caused by reduced helical pitch, and the impervious flights of the helix, effectively prevents issue of solvent vapours from the upper end of the vessel 50. Solvent vapours therefore migrate downwardly and condense in the main chamber 21 of the washer vessel 10, to assist in the dissolving out of the bitumen content.

We claim:

1. Apparatus for separating organic content from bituminous-inorganic material, which comprises:

a rotatable inclined washer vessel;

means rotatably mounting said vessel and means for rotating said vessel about an inclined axis;

means for introducing bituminous-inorganic material wetted with solvent for the organic content thereof, into the washer vessel whilst the washer vessel rotates;

solvent introduction means for introducing additional solvent for the organic content of the bituminous-inorganic material into the washer vessel at a location downstream of the location of introduction of the bituminous-inorganic material with respect to the direction of flow of solid material within said washer vessel, whilst the washer vessel rotates;

an open centered helical conveyor within the inclined washer vessel and rotatable therewith, the helical conveyor being adapted to convey solid material in the upwardly inclined direction within the washer vessel;

the conveyor having apertures extending through the individual flights of the conveyor at the radially outer portions of said flights, said apertures being disposed at an inclined angle with respect to the rotational axis of the washer vessel so as to present crooked pathways for liquid flow therethrough in a direction upstream with respect to the direction of flow of solid material within the washer vessel;

means for removing liquid organic solution from the washer vessel upstream of said means for introducing the bituminous-inorganic material with respect to the direction of flow of solid material within the washer vessel;

and means for recovering residual solvent from the solid material separated from liquid solution of organic material.

2. Apparatus according to claim 1 wherein the apertures are at the radially outer edges of the flights of the conveyor.

3. Apparatus according to claim 2, wherein the mouths of the apertures presented on the upper faces of the flights are circumferentially displaced rearwardly of their respective exits on the lower faces of the flights of the conveyor, with respect to the direction of rotation of the conveyor when conveying solid material upwardly.

4. Apparatus according to claim 3, wherein the flights of the helical conveyor are provided with resilient elements extending from the front faces thereof in the rotational direction of the helical conveyor and having free ends which trail as the helical conveyer rotates, said resilient elements being adapted to resiliently close the mouths of the apertures in response to pressure of solid material being conveyed.

5. Apparatus according to claim 2, wherein the washer vessel has a first upstream compartment and a second upstream compartment, both located upstream of said means for introducting bituminous-inorganic material with respect to the direction of flow of solid material within the washer vessel, the said first upstream compartment being located upstream of said second upstream compartment;

a weir separating said first and second upstream compartments from the remainder of said washer vessel, so as to collect liquid solution in said compartments by overflow from the remainder of the washer vessel;

and means for removing liquid organic solution from said first upstream compartment.

6. Apparatus according to claim 5, wherein the second upstream compartment is provided with a rotating scoop adapted to remove residual solids collected in said upwardly disposed compartment and return the residual solids to the washer vessel downstream of said second compartment.

7. Apparatus according to claim 1 wherein said means for recovering residual solvent from the separated solid material comprises a solvent recovery vessel, adapted to receive solid material from the washer vessel, and having a heated portion and a cooled portion located downstream of said heated portion with respect to the direction of flow of solid material, and having agitating and conveying means adapted to convey solid material therein successively through the heated portion and the cooled portion.

8. Apparatus according to claim 7, wherein the solvent recovery vessel is a rotatable vessel and said agitating and conveying means therein comprises a helical conveyor, to convey the solid material with tumbling agitation through the successive heated and cooled portions.

9. Apparatus according to claim 8, wherein the solvent recovery vessel is provided with a condenser adapted to collect solvent evaporated from the solid material in the solvent recovery vessel.

10. Apparatus according to claim 8, including a vibratory vessel interposed between the washer vessel and the solvent recovery vessel, said vibratory vessel being mounted and driven for vibration relative to said washer vessel and said solvent recovery vessel.

11. Apparatus according to claim 10, wherein the vibratory vessel is provided with a conveyor adapted to convey solid material received therein from the washer vessel to the solvent recovery vessel.

12. Apparatus according to claim 8, wherein the helical conveyor in the solvent recovery vessel is open centered for most of its length, but has a sealing formation closing the center of the helix for at least one turn thereof, said sealing formation being located adjacent the inlet end of the cooling zone.

13. Apparatus according to claim 12, wherein the section of the helix preceding the sealing formation is of reduced pitch, relative to other sections of the conveyor located closer to the inlet end of the solvent recovery vessel.

* * * * *